US006688806B2

(12) United States Patent
Kuan

(10) Patent No.: US 6,688,806 B2
(45) Date of Patent: Feb. 10, 2004

(54) JUMP-PROOF MANHOLE-HANDHOLE

(76) Inventor: Huan-Chang Kuan, No. 1-4, Luenbi Lane, Chishan Jen, Kaohsiung (TW)

( * ) Notice: Subject to any disclaimer, the term of this patent is extended or adjusted under 35 U.S.C. 154(b) by 0 days.

(21) Appl. No.: 10/190,677

(22) Filed: Jul. 9, 2002

(65) Prior Publication Data

US 2003/0039510 A1 Feb. 27, 2003

(30) Foreign Application Priority Data

Aug. 21, 2001 (TW) ..... 90214425 U
Aug. 22, 2001 (TW) ..... 90214603 U

(51) Int. Cl.[7] ..... E02D 29/14
(52) U.S. Cl. ..... 404/25; 404/26; 52/20
(58) Field of Search ..... 404/25, 26; 52/19, 52/20

(56) References Cited

U.S. PATENT DOCUMENTS

| | | | | | |
|---|---|---|---|---|---|
| 4,618,464 | A | * | 10/1986 | Ditcher | 264/35 |
| 4,925,337 | A | * | 5/1990 | Spiess et al. | 404/26 |
| 4,976,568 | A | * | 12/1990 | Hess | 404/26 |
| 5,205,668 | A | * | 4/1993 | Adams | 404/26 |
| 5,513,926 | A | * | 5/1996 | Prescott | 404/26 |
| 5,735,082 | A | * | 4/1998 | Lecuyer et al. | 52/20 |
| 5,797,221 | A | * | 8/1998 | Young et al. | 52/20 |
| 5,899,024 | A | * | 5/1999 | Stannard | 52/20 |
| 5,974,741 | A | * | 11/1999 | Fukuhara | 52/20 |
| 6,007,270 | A | * | 12/1999 | Bowman | 404/25 |
| 6,347,781 | B1 | * | 2/2002 | Trangsrud | 249/11 |
| 6,350,081 | B1 | * | 2/2002 | Khajavi et al. | 404/25 |

FOREIGN PATENT DOCUMENTS

| | | | | | |
|---|---|---|---|---|---|
| GB | 2207164 | A | * | 1/1989 | E02D/29/14 |
| GB | 2302117 | B | * | 1/1997 | E02D/29/14 |
| JP | 01169023 | A | * | 7/1989 | E02D/29/12 |
| JP | 01230817 | A | * | 9/1989 | E02D/29/14 |
| JP | 06158673 | A | * | 6/1994 | E02D/29/14 |
| JP | 10159115 | A | * | 6/1998 | E02D/29/12 |
| JP | 11117340 | A | * | 4/1999 | E02D/29/14 |
| JP | 2000033995 | | * | 2/2000 | B65D/90/10 |
| JP | 2000087376 | A | * | 3/2000 | E02D/29/12 |
| TW | 158284 | | | 5/1991 | |
| TW | 176915 | | | 1/1992 | |

* cited by examiner

*Primary Examiner*—Robert E. Pezzuto
*Assistant Examiner*—Alexandra K. Pechhold
(74) *Attorney, Agent, or Firm*—Troxell Law Office PLLC

(57) ABSTRACT

A manhole/handhole includes a cover and a frame base. A plurality of elastic fixtures are bonded below through holes of the frame base. The through holes are corresponding to fixing holes of the cover so that screw bolts pass through the fixing holes of cover and the through holes of frame base and are locked to the fixtures. The cover is combined with the frame base so as to prevent the cover from jumping. Besides, at least a heightening base is installed between the cover and the frame base. The heightening base is stacked on the frame base so that the manhole/handhole is leveled with road surface for economizing working and time of roadwork.

15 Claims, 9 Drawing Sheets

JUMP-PROOF MANHOLE-HANDHOLE

FIELD OF THE INVENTION

The present invention is generally relating to a jump-proof manhole/handhole, particularly to a manhole/handhole utilizing elastic fixtures for screws to combine a cover and a frame base. Furthermore, it is considerable to install a heightening frame between a cover and a frame base so as to heighten the cover leveled with road surface.

BACKGROUND OF THE INVENTION

As shown in FIG. 9, a conventional manhole/handhole 500 comprises a cover 510 and a frame base 520. The cover 510 has a plurality of pull holes 511 for removing the cover 510 from the frame base 520 and the frame base 520 has an opening 521 in order to provide an entrance for workmen or machines to go in and out. A block portion 523 is formed at rims of opening 521 of frame base 520 so as to support the frame base and a projecting outer ring 522 is formed above the block portion 523 for containing and leveled with the cover 510. However, the cover 510 is a flat plate and the structure thereof is not strong enough so that it happens easily that the cover 510 deforms or jumps out from the frame base 520 when the manhole/handhole is overlaid or run over by vehicles.

A known jump-proof manhole is disclosed in Republic Of China (Taiwan) Patent Publication No. 176,915 "stability-typed manhole", which utilizes a concave formed on the frame base and a flange formed on the cover. The flange is corresponding to the concave for keeping close matching with each other so as to prevent the cover from jumping. However, if the manhole is overlaid or run over by heavy vehicles, the flange closely matched by the concave will split or bend resulting in more seriously destroyed and completely getting-stick. On the other hand, because of too large contacting area between cover and frame base, the cover and the frame base will get stick mutually so as to be unable to open the cover under invasion of moisture from outer circumstance.

Another known jump-proof manhole or handhole is disclosed in Republic Of China (Taiwan) Patent Publication No. 158,284, which comprises a cover and a frame base. There is a projecting isolated wing downward extending at the bottom of outer edge of the cover, which is embed on the inner edge surface of the frame base. The outer edge surface of wing resists the inner edge surface thereof for preventing the cover from jumping or sinking. Furthermore, when the manhole/handhole cover is overlaid or run over by heavy vehicle, such as truck or container car, the projecting wing of cover will split or bend so that no more resistance between cover and frame base resulting in jumping or sinking of the cover.

For the conventional manhole/handhole mentioned above, not only the problems of jumping, deformation or getting-stick due to rust, etc but also another common problem happens about the manhole/handhole. While paving the road at first time, the manhole/handhole was leveled with the paved road. The road surface will become rough after lasting a long time or working with other public construction so that the road surface needs to be repaired or re-paved again. While re-paving the road to form a second layer road base, a recess will be formed at the manhole/handhole to cause a serious problem of public security. In fact, in order to enable the manhole/handhole be leveled with road surface, the frame base of manhole/handhole must be dismounted and assembled again on the second layer of road base, then closing the cover. Therefore, the conventional manhole/handhole is labor wasting and time wasting for the entire road-working process.

SUMMARY

It is a first object of the present invention to provide a jump-proof manhole/handhole. with a cover and a frame base. A plurality of elastic fixtures are combined on first through holes of frame base for connecting screw bolts which pass through the fixing holes of cover and the first through holes of frame base so as to combine cover and frame base without jumping of the cover while being overlaid by vehicles.

It is a second object of the present invention to provide a manhole/handhole with a heightening base for installing between the cover and the frame base. The heightening base has second pass holes which are corresponding to the second through holes of frame base for passing screw bolts. By means of stacking the heightening base on the frame base, the manhole/handhole is leveled with road surface and then the cover is installed on the heightening base for labor saving and time saving in re-paving.

It is a third object of the present invention to provide a manhole/handhole. A support strip is formed on a lower surface of a cover. While the cover is installed on a frame base (or heightening base), the cover is supported by a block portion of the frame base (or heightening base). An upper projecting peripheral frame of the frame base (or heightening base) has an unexposed interval with the support strip of the cover for preventing the cover rusting and lodge in the frame base (or heightening base).

It is a fourth object of the present invention to provide a manhole/handhole without deformation. The lower surface of the cover forms support strips, support blocks, and reinforcing bars. The reinforcing bars extend from the support strips or the support blocks to the center of the cover. The more close to the center of the cover, the more thickness of the cover is increased to form a strengthening portion on the lower surface of cover, so as to enhance structure strength of the cover. The cover doesn't have permanent deformation while being overlaid by vehicles.

The jump-proof manhole/handhole in accordance with the present invention comprises a cover and a frame base. A plurality of support blocks, support strips, and reinforcing bars are formed on the lower surface of cover so as to enhance the structure strength of the cover so that the cover is uneasy to deform. The cover has a plurality of fixing holes to combine the cover with the frame base. The frame base has an opening and a bottom base for fixing on a road base. An upper projecting peripheral frame and at least a block portion are formed around the opening of the frame base. The block portion of frame base has a plurality of first through holes and a plurality of second through holes. Each first through hole is combined with an elastic fixture. A plurality of screw bolts pass through the fixing holes of cover and the first through holes of frame base and are locked to the fixtures so as to combine the cover with the frame base. Moreover, when the manhole/handhole needs to be heightened due to road working, a heightening base is installed between cover and frame base. The heightening base has an opening. An upper projecting peripheral frame and at least a block portion are formed around the opening of the heightening base. The upper projecting peripheral frame of the heightening base is stacked on the upper projecting peripheral frame of frame base. The block portion of the heightening base has a plurality of first pass holes and a plurality of second pass holes. A plurality of screw bolts pass through the second pass holes of heightening base and the second through holes of frame base so as to combine heightening base with frame base. Then the cover is placed on the upper projecting peripheral frame of heightening base and each first pass hole of heightening base is combined with an elastic fixture in order to combine cover with heightening base and seal the opening of heightening base.

DETAILED DESCRIPTION OF THE PRESENT INVENTION

Figure 1:
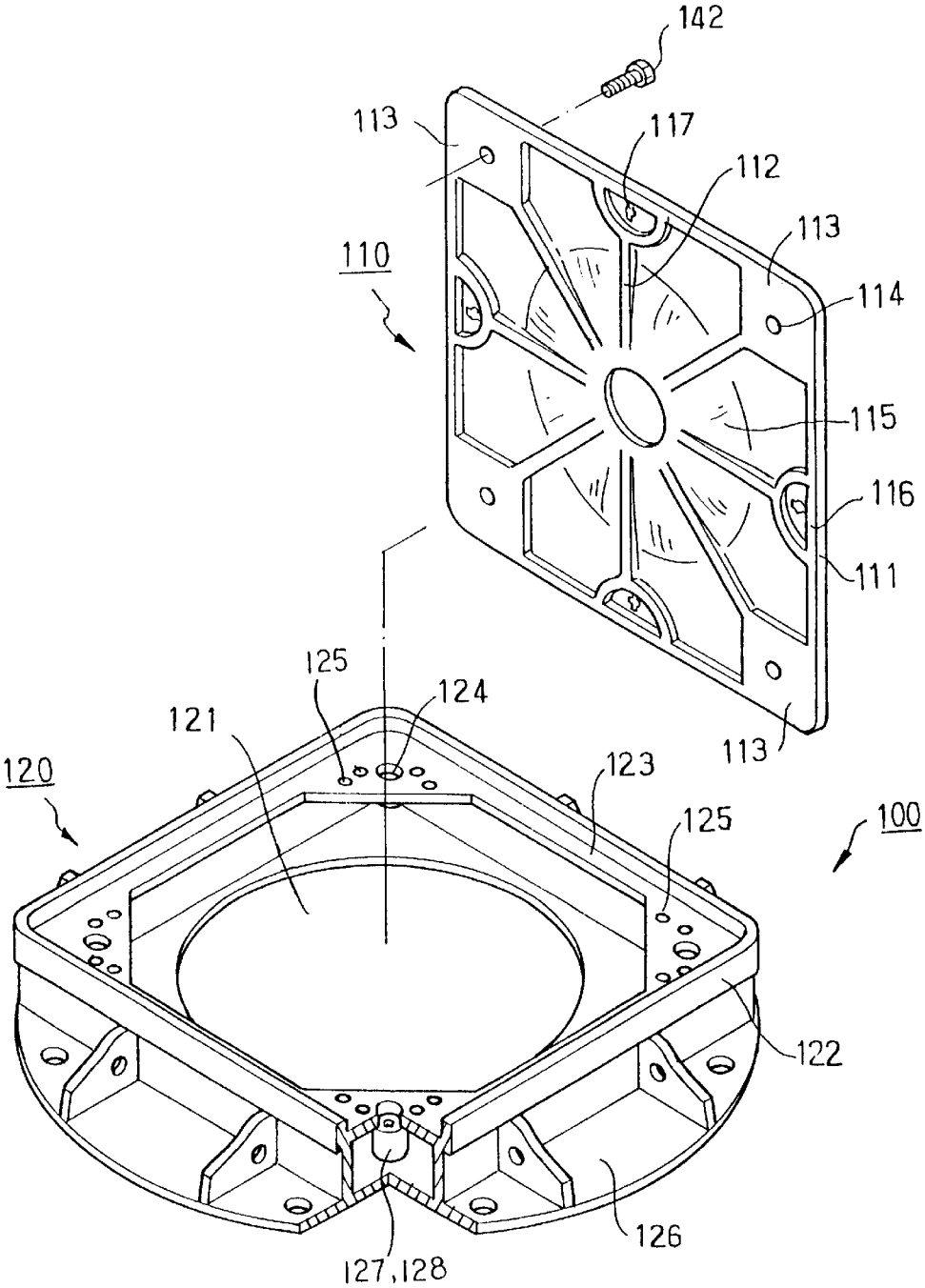
FIG. 1 is an exploded view of a jump-proof manhole/handhole in accordance with a first embodiment of the present invention.

Referring to the drawings attached, the present invention will be described by means of the embodiments below.

According to the first embodiment of the present invention, as shown in FIG. 1, a jump-proof manhole/handhole 100 comprises a cover 110 and a frame base 120. Usually the cover 110 is made of nodular graphite cast iron or other rigid metal. In this embodiment, the cover 110 is a square plate and forms a plurality of reinforcing bars 112, a plurality of support blocks 113 and a plurality of support strips 116 on the lower surface thereof. The support strips 116 are formed at the perimeters of the cover 110 and connect with the support blocks 113. The reinforcing bars 112 extend from the support strips 116 or support blocks 113 from the perimeters of the cover 110 to the center of the cover 110 so as to enhance the structure strength of the cover 110, so that the cover 110 won't deform while being overlaid by vehicles. Preferably, the more close to the center of the cover 110, the more thickness is increased, so as to form a strengthening portion 115 on the lower surface of the cover 110, which largest thickness is nearly as same as the thickness of the support blocks 113. A plurality of fixing holes 114 are formed on the support blocks 113 of the cover 110 for being passed through by the screw bolts 142 made of stainless steel. Besides, the cover 110 has a plurality of pull holes 117 located at a line of center thereof to balance while pulling the cover 110 preventing the cover 110 from sinking into the frame base 120 due to deviation.

The frame base 120 has a circular bottom base 126 embedded in road base for fixing the frame base 120 and an opening 121 for workmen and machines going in and out. An upper projecting peripheral frame 122 and at least a block portion 123 are formed around the opening 121. The upper projecting peripheral frame 122 is slightly larger than the peripheral edges 111 of cover 110. While combining the cover 110 with the frame base 120, the upper projecting peripheral frame 122 of frame base 120 contains the cover 110. The block portion 123 is used for supporting the support blocks 113 and the support strips 116 of cover 110, has a plurality of first through holes 124 and a plurality of second through holes 125. When the manhole/handhole 100 needs to be heightened due to road working, the second through holes 125 are used for locking a heightening base 130 (as shown in FIG. 3) and the first through holes 124 are used for being passed through by screw bolts 142 to combine with an elastic fixture 127.

Figure 2:
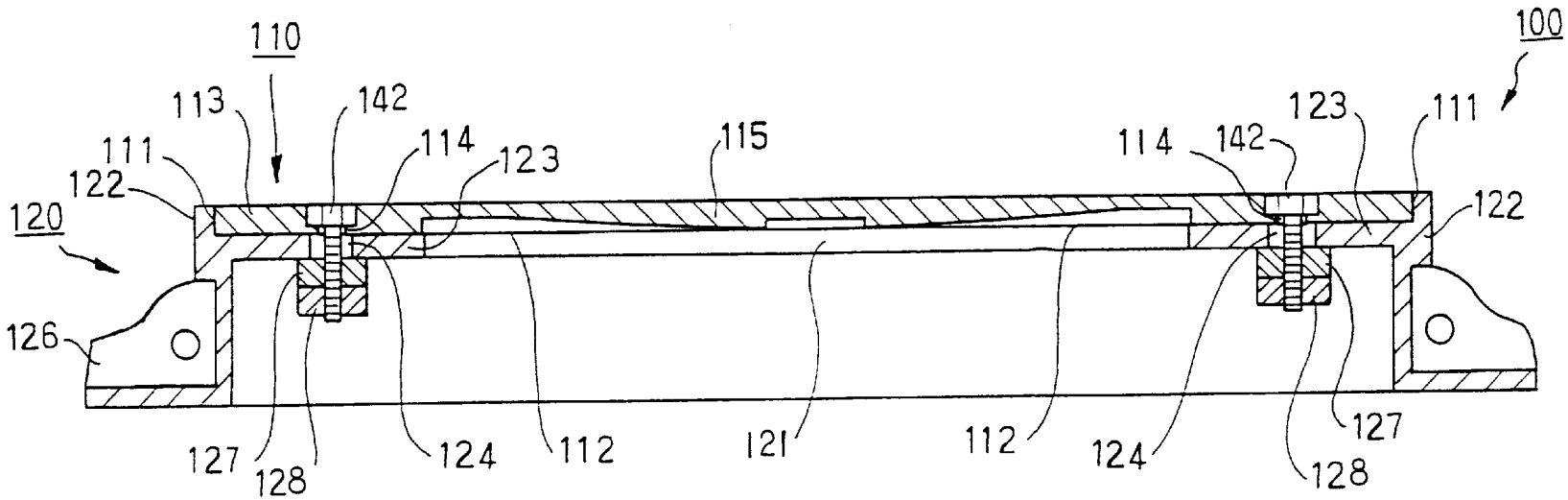
FIG. 2 is a cross sectional view of the jump-proof manhole/handhole in assembling condition in accordance with the first embodiment of the present invention.

As shown in FIG. 2, an elastic fixture 127 is fixed below each first through hole 124 of frame base 120. Each elastic fixture 127 comprises an elastic nut 128 made of rubber and preferably a rubber pad. The elastic nut 128 has a screw hole corresponding to one of the corresponding first through holes 124 of frame base 120. The screw bolts 142 pass through the fixing holes 114 of cover 110 and the first through holes 124 of frame base 120 and are locked onto the fixtures 127 so as to combine the cover 110 with the frame base 120 for preventing the cover 110 jumping off while being overlaid or run over by vehicles. The elastic fixtures 127 with elasticity are able to absorb outer compressive force to extend life thereof so that even the elastic fixture 127 is damaged a new fixture 127 can be exchanged directly to make the manhole/handhole 100 be used continuously. Moreover, the cover 110 is supported by the block portion 123 of frame base 120 while combining the cover 110 with the frame base 120. A plurality of reinforcing bars 112, support blocks 113, support strips 116 and strengthening portion 115 are formed on the lower surface of the cover 110 so as to enhance the structure strength of cover 110 so that the cover won't deform while being overlaid.

Figure 3:
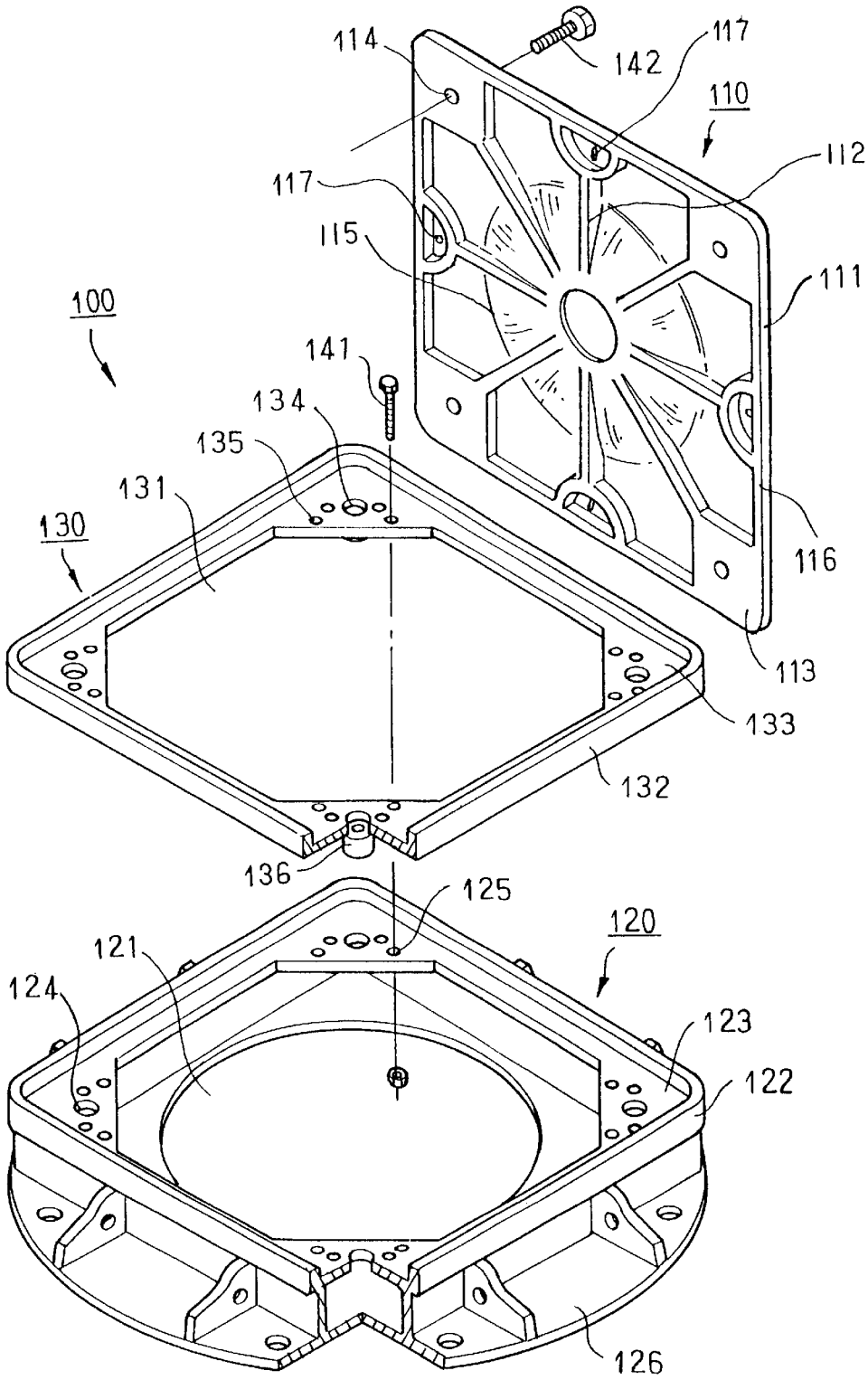
FIG. 3 is an exploded view of a heightening base and the jump-proof manhole/handhole in accordance with the first embodiment of the present invention.

As shown in FIG. 3, a heightening base 130 may further be installed between the cover 110 and the frame base 120 so as to heighten the cover 110 of manhole/handhole 100 to be leveled with road surface without causing vehicle traffic accident. The structure of the heightening base 130 is approximately as same as the frame base 120 and also has an opening 131. An upper projecting peripheral frame 132 and at least a block portion 133 are formed around the opening 131 of the heightening base 130. The upper projecting peripheral frame 132 of the heightening base 130 is used for containing the cover 110 and is stacked on the upper projecting peripheral frame 122 of the frame base 120. The block portion 133 is used for supporting the cover 110, has a plurality of first pass holes 134 and a plurality of second pass holes 135. The second pass holes 135 are corresponding to the second through holes 125 of frame base 120 for being passed through by the screw bolts 141 in order to combine heightening base 130 with frame base 120. Preferably also, every two of the second pass holes 135 are corresponding to every one of the first pass holes 134. The first pass holes 134 correspond to the fixing holes 114 of cover 110, and each first pass hole 134 combines an elastic fixture 136 with elasticity. Screw bolts 142 pass through the fixing holes 114 of cover and the first pass holes 134 of heightening base 130 and are locked to the fixtures 136 for combining cover 110 and heightening base 130 for preventing the cover 110 jumping.

Figure 4:
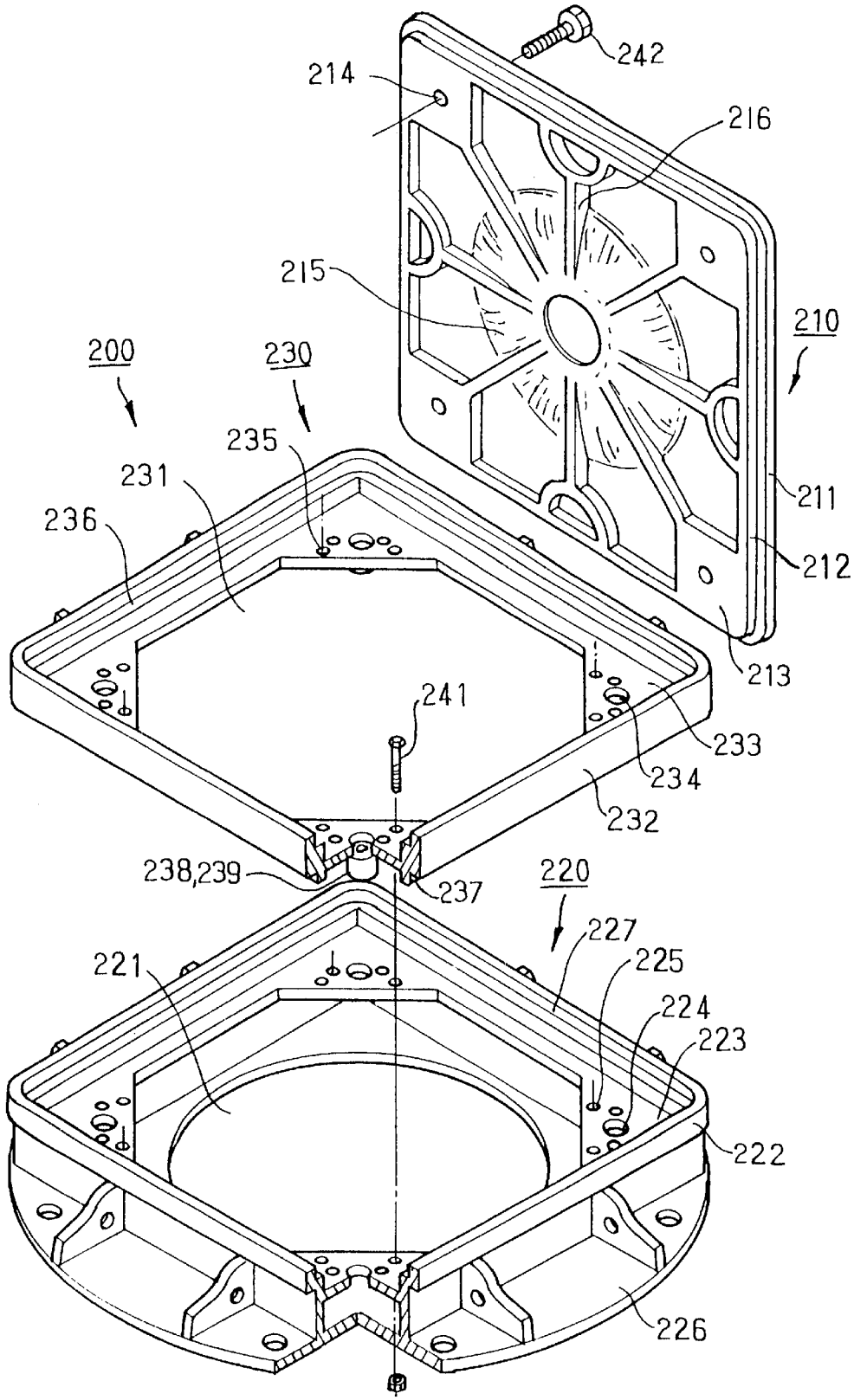
FIG. 4 is an exploded view of a jump-proof manhole/handhole having a heightening base in accordance with a second embodiment of the present invention.

As shown in FIG. 4, the manhole/handhole 200 of the second embodiment of the present invention comprises a cover 210, a frame base 220 and a heightening base 230. The cover 210 is a square plate, and a plurality of support strips 212 located at the perimeters of cover 210 and a plurality of support blocks 213 are formed on the lower surface of cover 210. The support strips 212 and the support blocks 213 symmetrically line up and mutually connect. A plurality of fixing holes 214 are formed on the support blocks 213 for being passed through by the screw bolts 242 made of stainless steel. It is better that a strengthening portion 215 and a plurality of reinforcing bars 216 are formed on the lower surface of the cover 210 so as to increase the structure strength of cover 210 preventing the cover 210 from deformation.

The frame base 220 has a bottom base 226 and an opening 221. The bottom base 226 is used for fixing the frame base 220 under road surface, an upper projecting peripheral frame 222 and a plurality of block portions 223 are formed around the opening 221 of frame base 220. The inner edge of the upper projecting peripheral frame 222 has an inner gap 227 used for being closely matched and positioned onto the heightening base 230. The block portions 223 have a plurality of first through holes 224 and a plurality of second through holes 225. The first through holes 224 correspond to the fixing holes 214 of cover 210, and the second through holes 225 correspond to the second pass holes 235 of heightening base 230 for being passed through by the screw bolts 241 and combining the heightening base 230 with the frame base 220.

The heightening base 230 also has an opening 231. An upper projecting peripheral frame 232 and at least a block portion 233 are formed around the opening 231 of heightening base 230. The block portion 233 is used for supporting the cover 210, has a plurality of first pass holes 234 and a plurality of second pass holes 235. The second pass holes 235 are used for being passed through by the screw bolts 241 for being locked to the frame base 220. The first pass holes 234 are corresponding to the fixing holes 214 of cover 210 and each first pass hole 234 is combined with an elastic fixture. After the cover 210 positioned on the heightening base 230, screw bolts 242 pass through the fixing holes 214 of cover 210 and the first pass holes 234 of heightening base 230 and are locked to the elastic fixtures 238. The upper projecting peripheral frame 232 of heightening base 230 has an inner gap 236 for containing the peripheral edges 211 of cover 210 and is stacked on the upper projecting peripheral frame 232 of frame base 220. A projecting limited peripheral frame 237 downward extending is formed at the inner side of lower edge of the upper projecting peripheral frame 232, and is closely matched in the inner gap 227 of upper projecting peripheral frame 222 of the frame base 220 for enhancing the combination strength between the frame base 220 and the heightening base 230 and limiting the cover 210 advantageous to position and lock.

Figure 5:
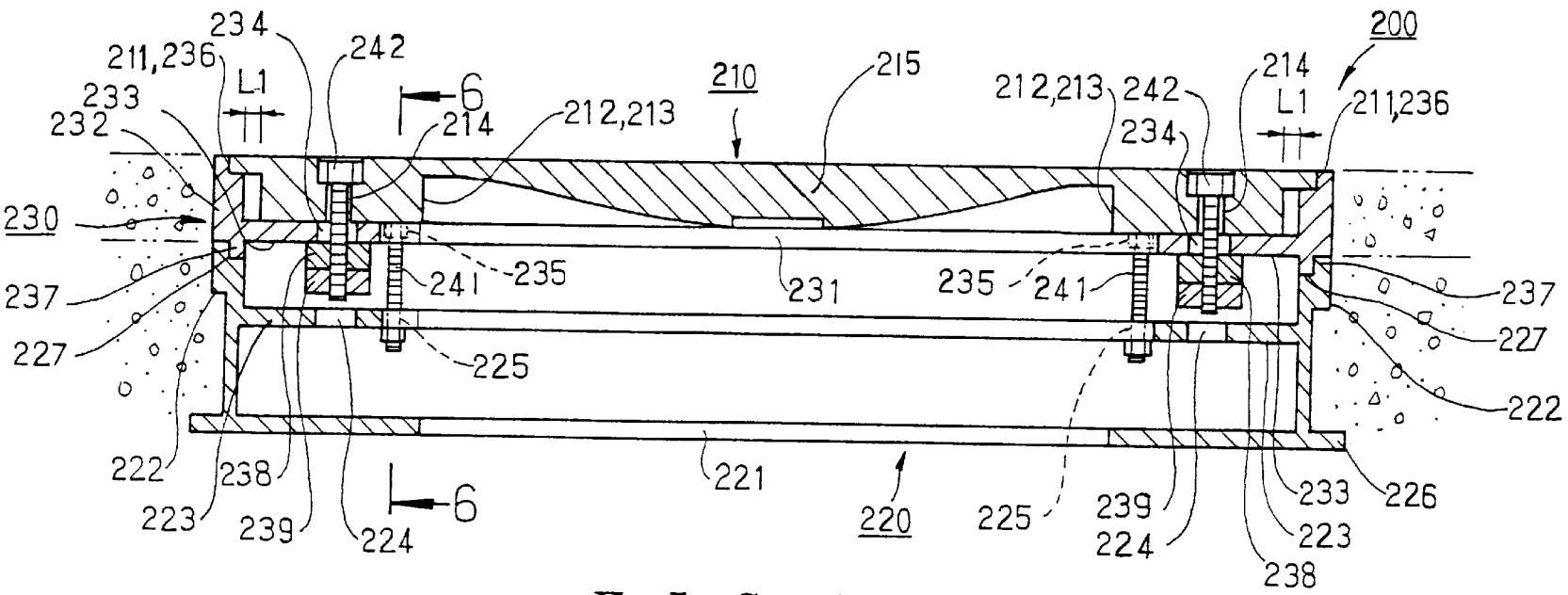
FIG. 5 is a cross sectional view of the manhole/handhole in accordance with the second embodiment of the present invention.

As shown in FIG. 5, at least one heightening base 230 is stacked on the frame base 220 so as to heighten the cover 210 of the manhole/handhole 200 that the second pass holes 235 of heightening base 230 and the second through holes 225 of frame base 220 are passed through by the screw bolts 241 and are locked in order to combine the heightening base 230 and the frame base 220. Thereafter, the cover 210 is placed in the upper projecting peripheral frame 232 of heightening base 230. There is a unexposed interval L1 between the support strips 212 (or support blocks 213) of cover 210 and the upper projecting peripheral frame 232 of heightening base 230 to make the vertical contact surface between the cover 210 and heightening base 230 become a smaller area on peripheral edge 211, so that even if the cover 210 and/or the heightening base 230 rust, the cover 210 won't deadlock to the heightening base 230 and is easily lifted up from the heightening base 230. The elastic fixture 238 below the first pass hole 234 of heightening base 230 comprises a rubber nut 239 that has a screw hole corresponding to the fixing hole 214 of cover 210. The screw bolts 242 pass through the fixing holes 214 of cover 210 and the first pass holes 234 of heightening base 230 and are locked to the elastic fixtures 238 for combining the cover 210 and the heightening base 230. Therefore, when the manhole/handhole 200 is heightened, by means of the method mentioned above at least one heightening base 230 is assembled between cover 210 and frame base 220 in order to level the cover 210 with road base without reinstalling the frame base 220.

Figure 6:
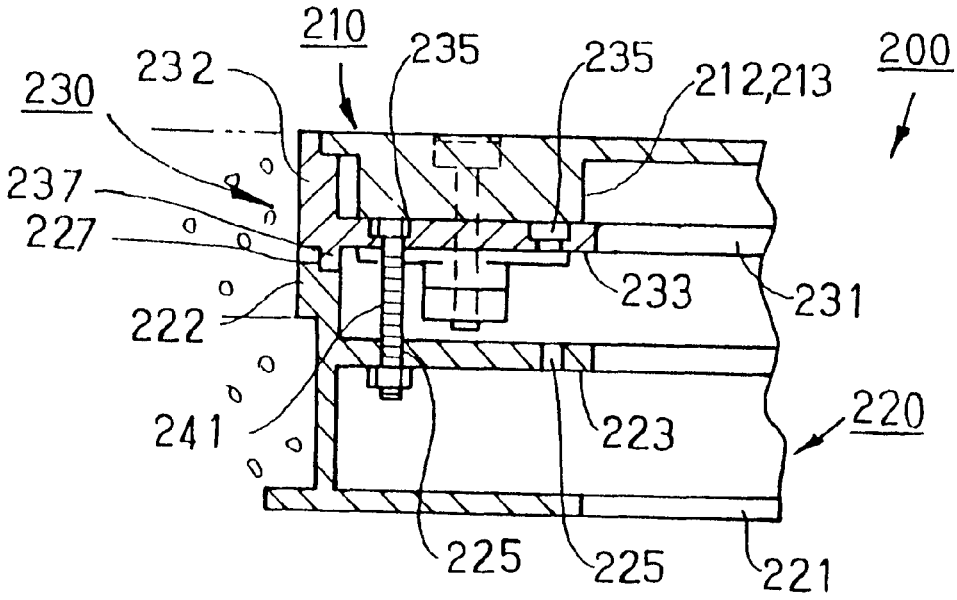
FIG. 6 is a partial cross sectional view of the manhole/handhole along FIG. 5 line 6—6 in accordance with the second embodiment of the present invention.

At first the frame base 230 with the cover 210 is embedden on a road base and the cover 210 is leveled with road base. After lasting a long time or when another public construction is executed, the road surface becomes rough so that the road base needs to be paved again. Usually an additional layer of road base is directly paved on the original layer of the road base. As shown in FIGS. 5, 6, the cover 210 originally installed on the frame base 220 becomes lower than the additional road surface for height so that a recess will be formed at the cover 210 causing a serious problem of public security. In order to avoid this problem, at least a heightening base 230 according to the present invention is able to p heighten the cover 210. Firstly the cover 210 is dismounted from the frame base 220, then the heightening base 230 is installed on the frame base 220, then the cover 210 is installed on the heightening base 230 so as to make the cover 210 of the manhole/handhole 200 levels with the re-paving road surface by means of stacking heightening base 230 and frame base 220. While there are a plurality of heightening base 230 are required in a manhole/handhole, all of the second pass holes 235 of each heightening base 230 are defined into two groups in order to screw an upper article (cover or heightening base) and a lower article (heightening base or frame base) by screw bolts 241, especially group distribution of second pass holes 235 is cross arrangement. Therefore the frame base 220 is not necessary to be dismounted and re-installed to save labor and time.

Figure 7:
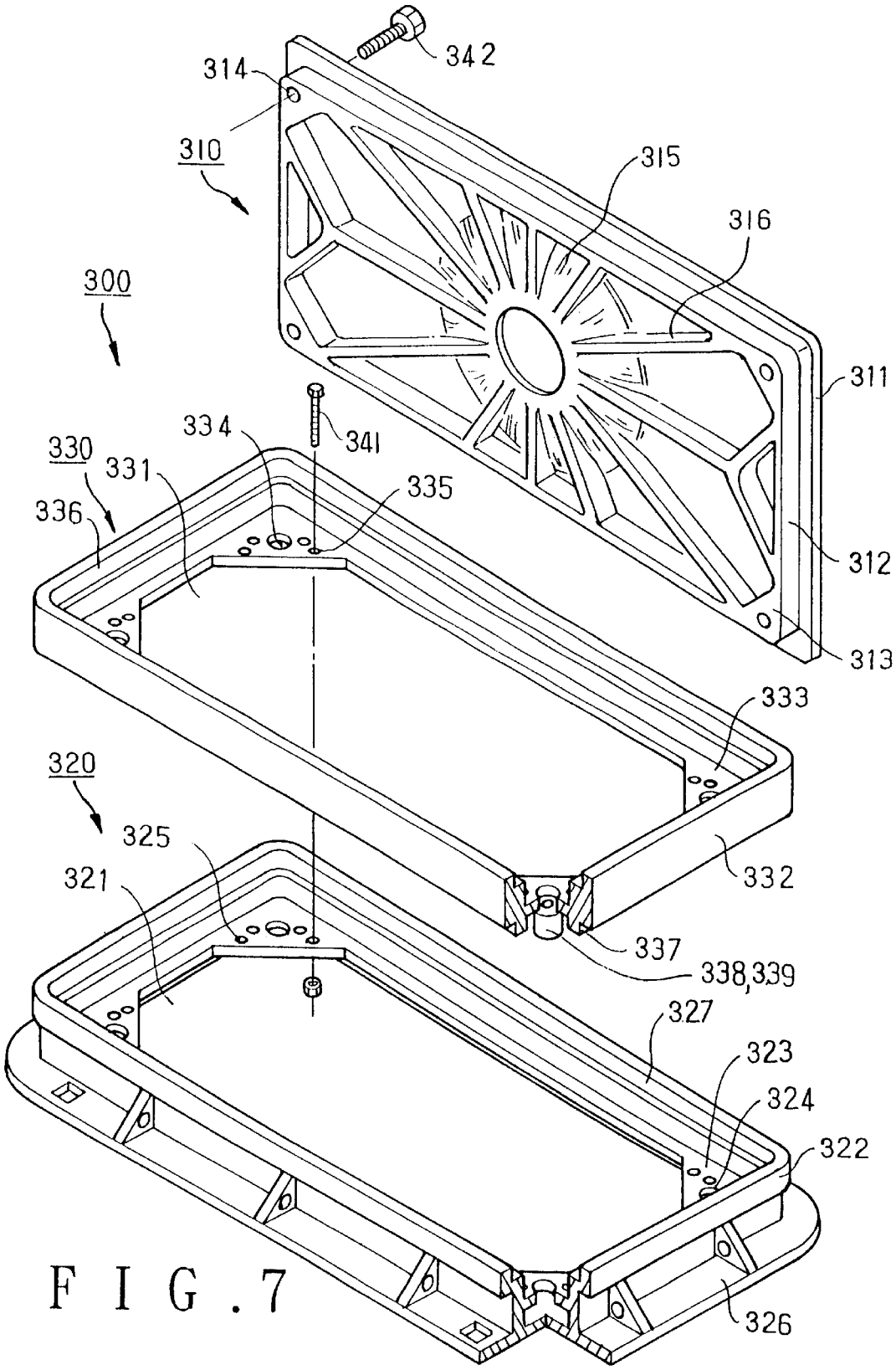
FIG. 7 is an exploded view of a jump-proof manhole/handhole having heightening base in accordance with a third embodiment of the present invention.

The manhole/handhole of the present invention has various shapes to be used depending on what application occasion it is, such as sewer or cable pipe. As shown in FIG. 7, a manhole/handhole 300 according to the third embodiment of the present invention is almost as same as the manhole/handhole 200 in the second embodiment, such as the cover 310 (including peripheral edge 311, support trips 312, support blocks 313, fixing holes 314, strengthening portion 315 and reinforcing bars 316), the frame base 320 (including opening 321, upper projecting peripheral frame 322, block portion 323, first through holes 324, second through holes 325 and inner gap 327), the heightening base 330 (including opening 331, upper projecting peripheral frame 332, block portion 333, first pass holes 334, second pass holes 335, inner gap 336, limited peripheral frame 337, elastic fixtures 338 and elastic nuts 339) and the screw bolts 341 and 342, except for the outline of manhole/handhole 300. The bottom base 326 of the frame base 320 and the cover 310 are rectangle.

Figure 8:
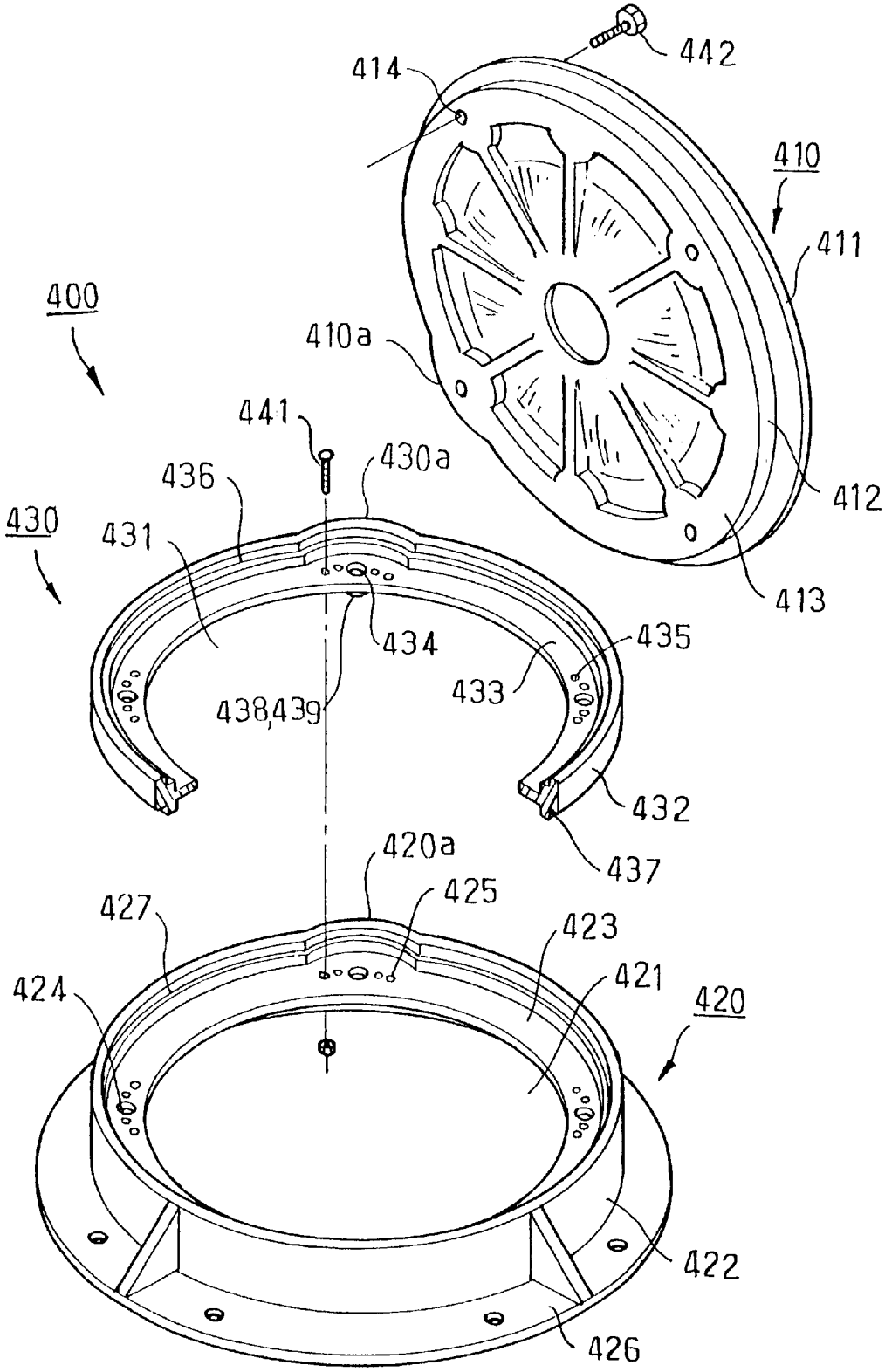
FIG. 8 is an exploded view of a jump-proof manhole/handhole having heightening base in accordance with a fourth embodiment of the present invention.
Figure 9:
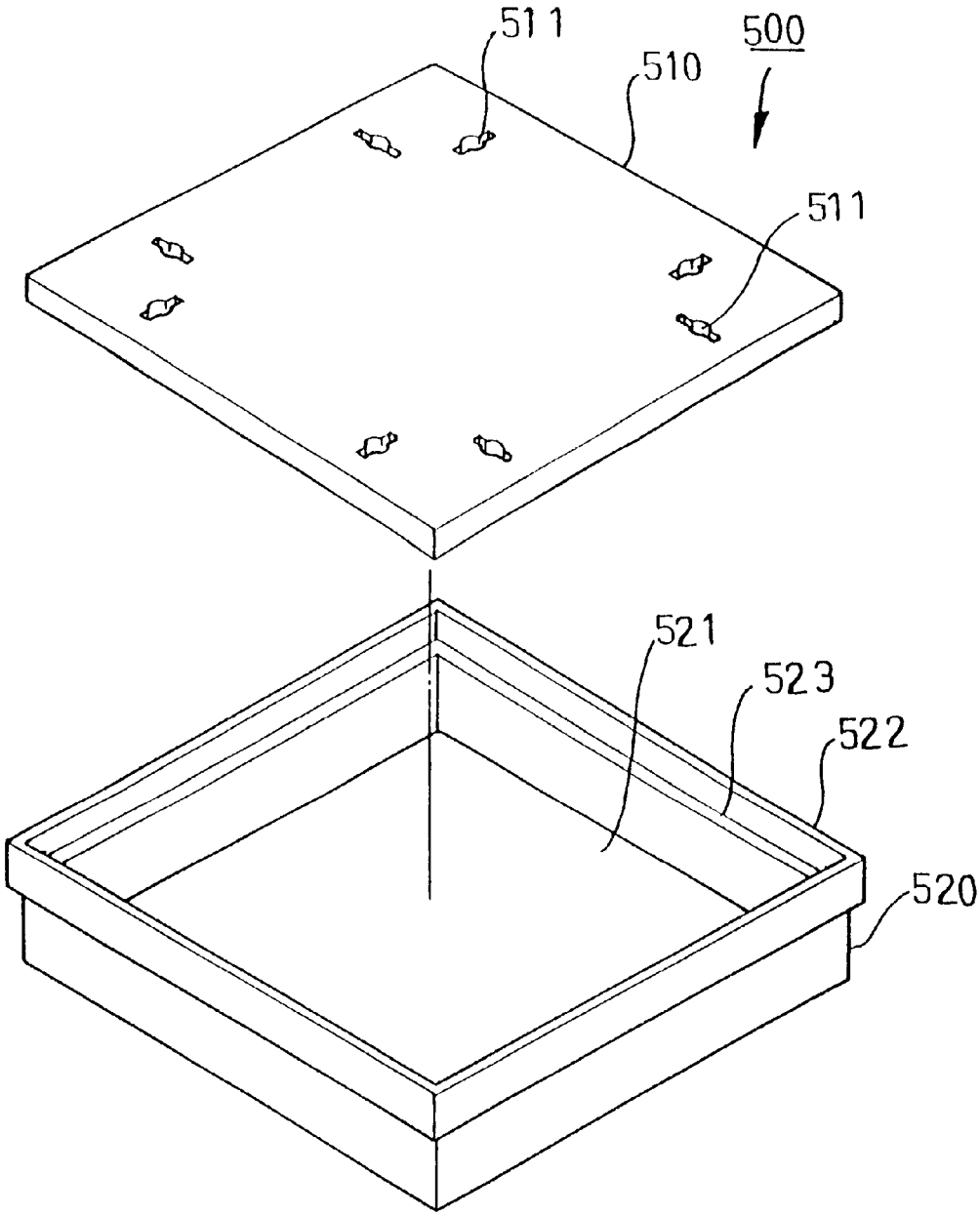
F I G . 9 PRIOR ART
FIG. 9 is a perspective view of a conventional manhole/handhole.

Further as shown in FIG. 8, a manhole/handhole 400 according to the fourth embodiment of the present invention is approximately as same as the manhole/handhole 200 in the second embodiment. The manhole/handhole 400 comprises a circular cover 410, a frame base 420 and a heightening base 430. A support strip 412 and a plurality of support blocks 413 are formed on the lower surface of cover 410, a plurality of fixing holes 414 are formed on the support blocks 413 for being passed through by the screw bolts 442 made of stainless steel for locking with the heightening base 430 or the frame base 420. The frame base 420 is fixed on road base by a bottom base 426 thereof. An upper projecting peripheral frame 422 and a ring-shaped block portion 423 are formed around the opening 421 of the frame base 420. The block portion 423 has a plurality of first through holes 424 and a plurality of second through holes 425, the second through holes 425 are used for being passed through by the screw bolts 441 to combine the heightening base 430 and the frame base 420. The upper projecting peripheral frame 422 has an inner gap 427 used for being closely matched and positioned the heightening base 430 or cover 410 universally.

The heightening base 430 has matching portions corresponding to the frame base 420, such as opening 431, upper projecting peripheral frame 432, block portion 433 and inner gap 436. A plurality of first pass holes 434 and a plurality of second pass holes 435 are formed on the block portion 433 of heightening base 430. A limited peripheral frame 437 is formed at the inner side of lower edge of the upper projecting peripheral frame 432 and is closely matched into the inner gap 427 of the frame base 420 in order to enhance the combination strength between the frame base 420 and the heightening base 430. The elastic fixtures 438 located below the first pass holes 434 of heightening base 430, each includes an elastic nut 439 made of rubber, the screw bolts 442 pass through the fixing holes 414 of cover 410 and the first pass holes 434 of heightening base 430 and is locked with the nuts 439 of the fixtures 438 for combining the cover 410 and the heightening base 430 and preventing the cover 410 jumping from the heightening base 430. When the cover 410 is closed on the heightening base 430, the peripheral edge 411 of cover 410 is placed on the inner gap 436 of upper projecting peripheral frame 432 of heightening base 430. There is a unexposed interval between the support strip 412 and the upper projecting peripheral frame 432 so as to prevent the cover 410 from deadlocking to the heightening base 430 due to rusting. In this embodiment, the manhole/handhole 400 is circular, the cover 410, the frame base 420 and the heightening base 430 have a corresponding projecting portion 410*a*, 420*a* and 430*a* respectively applied to position and combine cover 410, frame base 420 and heightening base 430 easily. By means of the projecting portions 410*a*, 420*a* and 430*a*, the second pass holes 435 of heightening base 430 and the second through holes 425 of frame base 420 mutually correspond to be locked advantageously. Besides, the heightening base 430 provides a higher assembling position for cover 410 by means of stacking of heightening bases 430 and frame base 420. The manhole/handhole 400 is leveled with road surface after completely paving road base with advantages of labor saving and time saving in the entire road-working process.

The above description of embodiments of this invention is intended to be illustrative and not limiting. Other embodiments of this invention will be obvious to those skilled in the art in view of the above disclosure.

What is claimed is:

1. A manhole/handhole comprising:

a cover having a plurality of reinforcing bars and a support strip at a perimeter of a lower surface thereof, wherein the reinforcing bars extend from the perimeter of the cover to a center of the cover, and the cover has a plurality of fixing holes;

a frame base having an opening, an upper projecting peripheral frame for containing the cover and at least a block portion for supporting the cover, wherein the upper projecting peripheral frame and the block portion are formed around the opening of the frame base, the block portion has a plurality of first through holes corresponding to the fixing holes of the cover; and a plurality of fixtures bonded under the first through holes of the frame base so that a plurality of screw bolts pass through the fixing holes of the cover and the first through holes of the frame base and combine with the fixtures.

2. The manhole/handhole in accordance with claim 1, wherein the fixtures have elasticity.

3. The manhole/handhole in accordance with claim 1, wherein each fixture includes an elastic nut for combining a screw bolt.

4. The manhole/handhole in accordance with claim 1, wherein the cover has a strengthening portion on the lower surface thereof, so that the thickness of the cover increases toward the center of the cover.

5. The manhole/handhole in accordance with claim 1, wherein a unexposed interval is formed between the support strip of the cover and the upper projecting peripheral frame of the frame base.

6. The manhole/handhole in accordance with claim 1, wherein the cover has a plurality of support blocks formed at the perimeter of the lower surface of the cover and symmetrically connecting with the supporting strip.

7. The manhole/handhole in accordance with claim 1, wherein the cover and the frame base have a mutually corresponding projecting portion respectively for positioning the fixtures and the screw bolts.

8. The manhole/handhole in accordance with claim 1, wherein the frame base has a plurality of second through holes for assembling a heightening base.

9. A manhole/handhole comprising:

a cover having a plurality of fixing holes;

a frame base having an opening, an upper projecting peripheral frame and at least a block portion formed around the opening of the frame base, wherein the block portion of the frame base has a plurality of first through holes corresponding to the fixing holes of the cover and a plurality of second through holes;

at least a heightening base for installing between the cover and the frame base, having an opening, an upper projecting peripheral frame for containing the cover and at least a block portion for supporting the cover, wherein the upper projecting peripheral frame and the block portion are formed around the opening of the heightening base, the block portion of the heightening base has a plurality of first pass holes and a plurality of second pass holes, the first pass holes are corresponding to the fixing holes of the cover, the second pass holes are corresponding to the second through holes of the frame base for assembling the heightening base and the frame base; and a plurality of fixtures bonded under the first pass holes of the heightening base so that a plurality of screw bolts pass through the fixing holes of the cover and the first pass holes of the heightening base and combine the fixtures while the upper projecting peripheral frame of the heightening base being stacked on the upper projecting peripheral frame of the frame base.

10. The manhole/handhole in accordance with claim 9, wherein a limited peripheral frame is formed at the lower edge of the upper projecting peripheral frame of the heightening base for closely matching the frame base.

11. The manhole/handhole in accordance with claim 9, wherein an inner gap is formed at the upper edge of the upper projecting peripheral frame of the heightening base for containing the cover.

12. The manhole/handhole in accordance with claim 9, wherein the cover has a plurality of support blocks formed on the lower surface thereof, and there is an unexposed interval between the support blocks of the cover and the upper projecting peripheral frame of the heightening base.

13. The manhole/handhole in accordance with claim 9, wherein the fixtures have elasticity.

14. The manhole/handhole in accordance with claim 9, wherein each fixture includes an elastic nut for combining a screw bolt.

15. The manhole/handhole in accordance with claim 9, wherein the cover and the heightening base have a corresponding projecting portion respectively for positioning the screw bolts and the fixtures.

* * * * *